US005183302A

United States Patent [19]

Pelachyk et al.

[11] Patent Number: 5,183,302

[45] Date of Patent: Feb. 2, 1993

[54] DOOR HANDLE HOUSING ATTACHMENT FOR VEHICLE DOOR

[75] Inventors: Richard Pelachyk, Utica; Lowell W. Satterlee, Clarkston; Dante C. Zuccaro, Allenton; Timothy M. Farris, Sterling Heights, all of Mich.

[73] Assignee: General Motors Corporation, Detroit, Mich.

[21] Appl. No.: 740,737

[22] Filed: Aug. 6, 1991

[51] Int. Cl.[5] ..... E05B 3/00

[52] U.S. Cl. ..... 292/336.3; 292/337; 292/DIG. 31; 292/DIG. 38; 292/DIG. 53

[58] Field of Search ..... 292/337, 336.3, 113, 292/247, 347, 357, DIG. 31, DIG. 38, DIG. 53

[56] References Cited

U.S. PATENT DOCUMENTS

| | | | |
|---|---|---|---|
| 3,315,998 | 4/1967 | Dalloire | 292/337 X |
| 4,517,880 | 5/1985 | Buckner et al. | 98/248 |
| 4,531,700 | 7/1985 | Robinson | 248/672 |
| 4,580,822 | 4/1986 | Fukumoto | 292/DIG. 31 X |
| 4,625,134 | 11/1986 | Weaver | 310/83 |
| 4,936,201 | 3/1994 | Inaba | 292/DIG. 38 X |

*Primary Examiner*—Richard E. Moore
*Attorney, Agent, or Firm*—Charles E. Leahy

[57] ABSTRACT

A handle housing intended for attachment on a vehicle door panel is of injection molded plastic construction and has a base adapted to engage against the surface of the door panel. The housing carries at least one anchor leg, and preferably several, which project from the base and extend through registering apertures provided in the panel. Each of these anchor legs has a foot at the end thereof which is adapted to engage and underlie the underside of the panel when the housing is slid longitudinally along the surface so that the foot will engage with the underside of the housing and thereby prevent the housing from being pulled away from the panel. The housing also has a plurality of locking legs projecting from the base and extending through registering openings in the panel. Each of these locking legs has a locking foot carried thereon and having a locking shoulder which lockingly engages with a tab struck from the underside of the panel to the thereby prevent longitudinal sliding movement of the housing along the surface in the retrograde direction which would permit the anchor feet to become disengaged from the underside of the panel. The locking feet preferably carry an integral spring molded finger on the end thereof which bear respectively against tabs struck from the underside of the panel to constantly urge limited retrograde longitudinal sliding movement of the housing to thereby maintain the abutment shoulders of the locking feet in constant engagement with the locking tabs struck from the panel.

3 Claims, 2 Drawing Sheets

DOOR HANDLE HOUSING ATTACHMENT FOR VEHICLE DOOR

The invention relates to attaching a door handle to a motor vehicle door and more particularly provides a molded plastic handle housing and a stamped metal door panel having integral structure by which a permanent attachment may be obtained without use of separate fastening devices.

BACKGROUND OF THE INVENTION

It is well known in motor vehicles to construct a vehicle door including a stamped metal door panel and to attach a handle assembly to the panel. The handle assembly is typically comprised of a mounting bracket having a handle pivotally attached thereto. Screws, bolts, or rivets are employed to attach the handle bracket to the door panel. Bent wire rods extend between the handles and the latch so that actuation of the handle actuates the door latch.

It would be desirable to provide a door panel and handle bracket which may be attached together without necessity for independent fastening devices such as screws, rivets and bolts.

SUMMARY OF THE INVENTION

According to the invention a handle housing intended for attachment on a vehicle door panel is of injection molded plastic construction and has a base adapted to engage against the surface of the door panel. The housing carries at least one anchor leg, and preferably several, which project from the base and extend through registering apertures provided in the panel. Each of these anchor legs has a foot at the end thereof which is adapted to engage and underlie the underside of the panel when the housing is slid longitudinally along the surface so that the foot will engage with the underside of the housing and thereby prevent the housing from being pulled away from the panel. The housing also has a plurality of locking legs projecting from the base and extending through registering openings in the panel. Each of these locking legs has a locking foot carried thereon and having a locking shoulder which lockingly engages with a tab struck from the underside of the panel to the thereby prevent longitudinal sliding movement of the housing along the surface in the retrograde direction which would permit the anchor feet to become disengaged from the underside of the panel. The locking feet preferably carry an integral spring molded finger on the end thereof which bear respectively against tabs struck from the underside of the panel to constantly urge limited retrograde longitudinal sliding movement of the housing to thereby maintain the abutment shoulders of the locking feet in constant engagement with the locking tabs struck from the panel.

Accordingly, the object, feature, and advantage of the invention resides in the provision of a handle housing having a base which carries anchor legs having feet which underlie the under surface of the panel and locking legs which carry feet having locking shoulders engaged with locking tabs struck from the underside of the panel.

BRIEF DESCRIPTION OF THE DRAWINGS

These and other objects features, and advantages of the invention will become apparent upon consideration of the description of the preferred embodiment and the appended drawing in which.

DESCRIPTION OF THE PREFERRED EMBODIMENT

Figure 1:
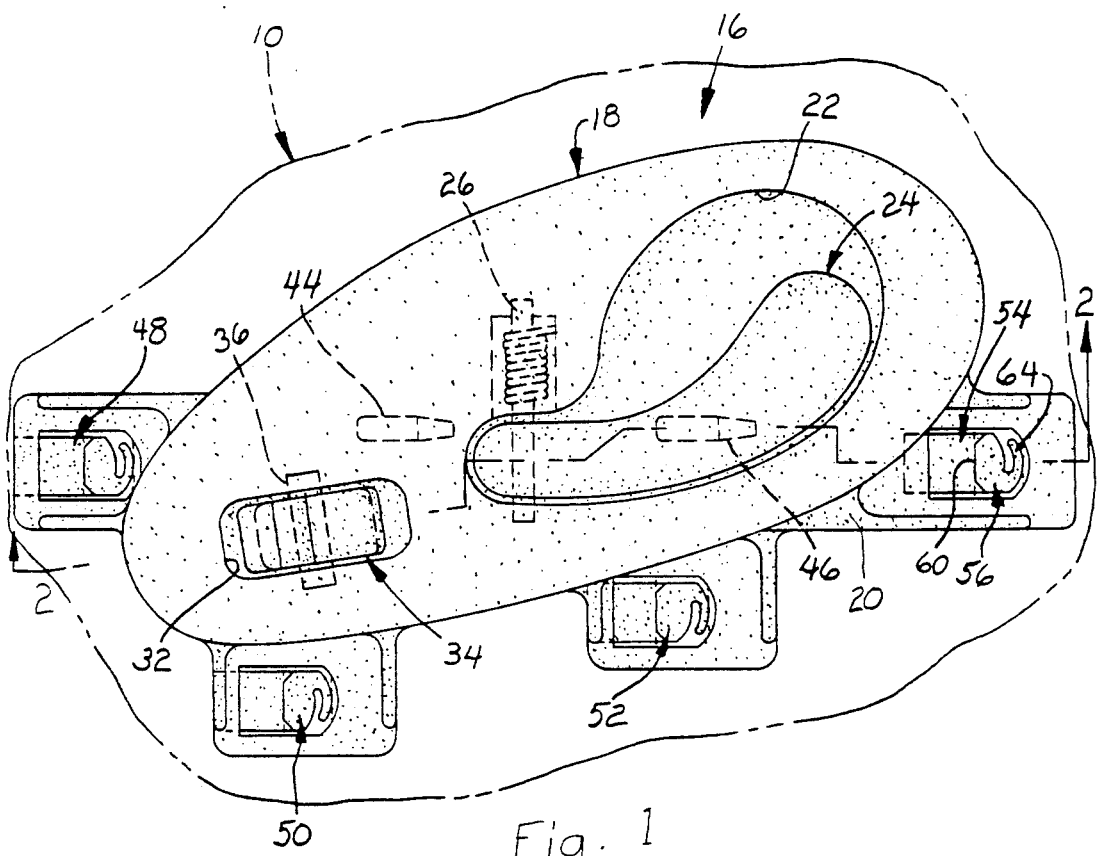
FIG. 1 is a side elevation view of the door panel having the handle housing attached thereto.
Figure 2:
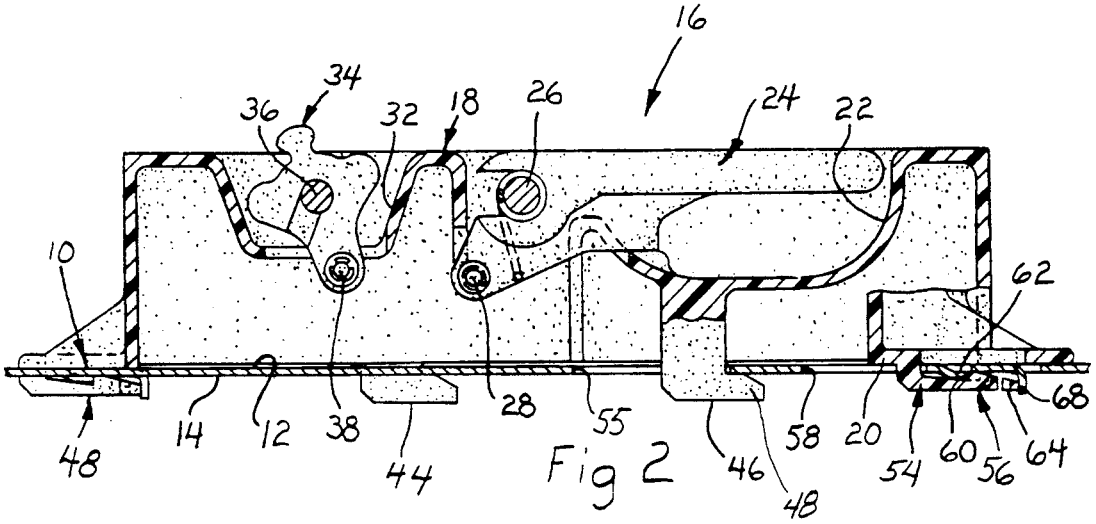
FIG. 2 is a section view taken in the direction of arrows 2—2 of FIG. 1.

FIG. 1 shows a portion of a vehicle door panel 10 which is conventionally stamped from sheet metal. As seen in FIG. 2 the panel 10 has a surface 12 and an underside 14.

As best seen in FIGS. 1 and 2, a door handle assembly 16 is provided for attachment onto the door panel 10. The door handle assembly 16 includes an injection molded plastic housing 18 which has a base wall 20 adapted to engage against the surface 12 of the panel, and a recess 22 in which a door handle 24 is pivotally mounted by a pivot pin 26. A conventional door handle rod, not shown, will be connected to the handle 24 at the pivot 28 to make an operating connection to a vehicle door latch. In addition, the housing 18 has a second recess 32 in which a door lock knob 34 is pivotally mounted by a pivot pin 36. The door lock knob 34 is suitably connected to the door latch by a lock rod, not shown, which connects to the lock knob 34 at the pivot pin 38.

The molded plastic housing 18 is attached to the door panel 10 by a plurality of anchor legs 44 and 46 and by a plurality of locking legs 48, 50, 52 and 54.

As best seen in FIG. 2, the anchor leg 46 has an anchor foot 48 which extends into underlying engagement with the undersurface 14 of the panel 10 when the anchor leg 46 is lowered through an aperture 55 in the panel 10 and then slid in the rightward direction as viewed in FIG. 2. Accordingly, this anchor leg 46, in combination with the anchor leg 44 spaced therefrom, will function to anchor the housing 18 to the panel 10 in a manner which will prevent the housing 18 from being pulled away from the panel 10.

Figure 3:
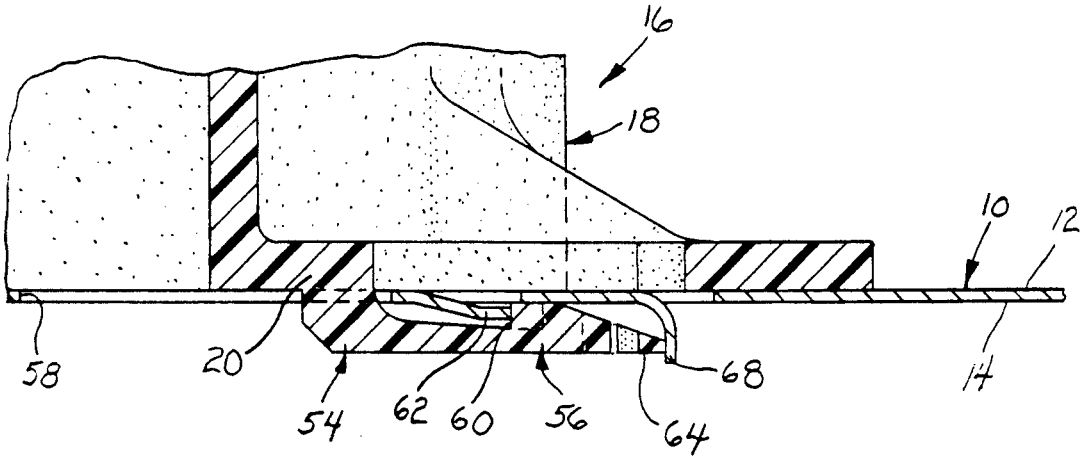
FIG. 3 is an enlarged fragmentary view of FIG. 2.
Figure 4:
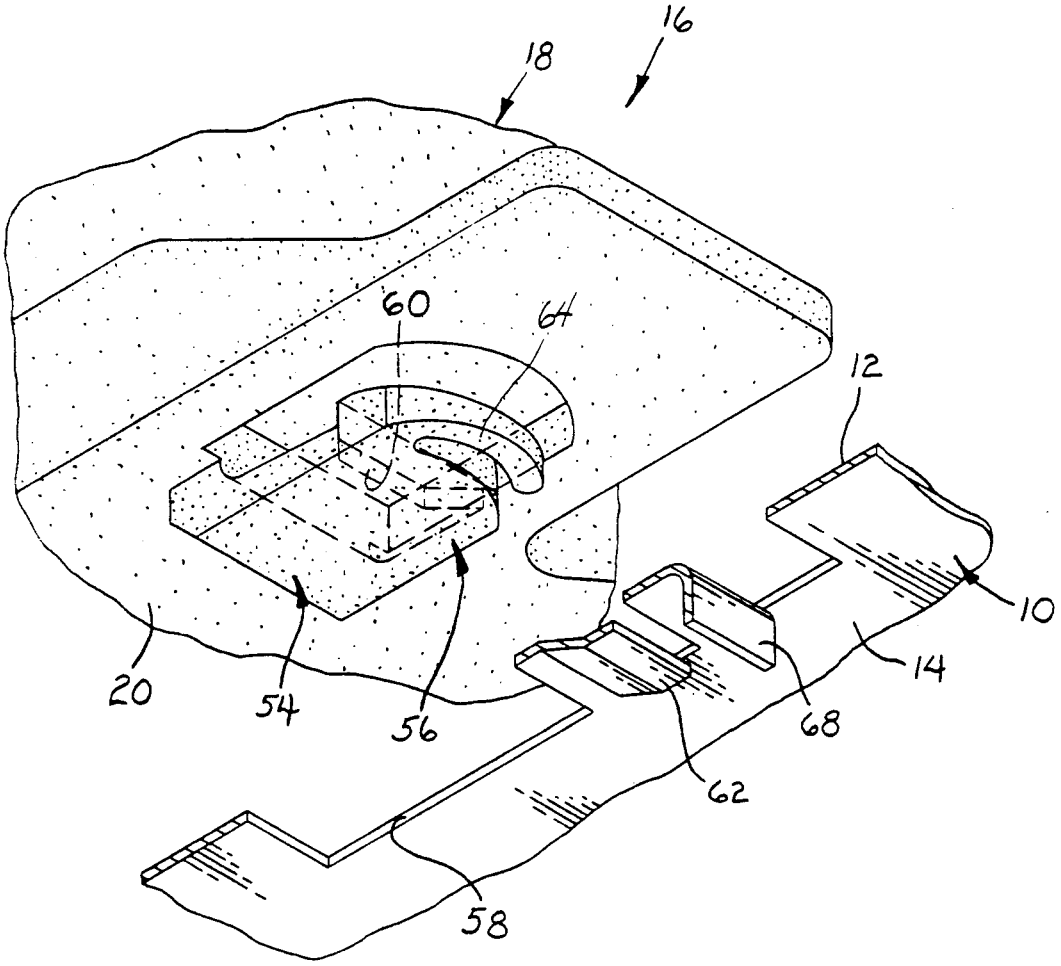
FIG. 4 is an exploded view showing one of the locking legs and the aperture and tab features by which the locking foot will lock the housing against sliding movement relative the panel.

As best seen in FIGS. 3 and 4, the locking leg 54 has a locking foot 56 which passes through a rectangular opening 58 provided in the panel 10. Referring again to FIG. 2, it will be appreciated that the rightward movement of the housing 18 which engages the anchor leg 46 beneath the panel 10 will simultaneously cause the locking foot 56 of the locking leg 54 to become engaged with the underside of the panel 10. Furthermore, as seen in FIG. 3, the locking foot 56 has an integrally molded locking shoulder 60 which becomes engaged with a locking tab 62 struck downwardly from the panel 10. In addition, the locking foot 56 has an integral spring finger 64 molded integrally therewith as best seen in FIG. 4 which engages with a tab 68 struck down from the panel 10. The spring finger 64 acts to continuously urge leftward movement of the housing 18 as viewed in FIGS. 1, 2 and 3 so that the locking shoulder 60, FIG. 3, is constantly held in contact with the lock tab 62. In this manner, the housing 18 is prevented from sliding in the leftward direction which would permit the feet of the anchor legs 44 and 46 and the feet of the locking legs 48, 50, 52, and 54 from becoming disengaged from the underside of the panel 10.

Thus it is seen that the invention provides a new and improved attachment devices which is particularly suited for attaching a door handle housing of molded plastic construction on a vehicle door panel without the necessity for use of independent fastening devices such as rivets, screws, and bolts. The attachment device can so be used in other applications in which it is desired to mount a plastic housing on a panel. The stability of the door handle housing attachment onto the door is assured by locating the various legs at a substantial stance from one another and also by providing the feet with a substantial length.

The embodiments of the invention in which an exclusive property or privilege is claimed are defined as follows:

1. In combination: a vehicle door panel having a surface and an underside, and a handle housing adapted for attachment on the panel, said housing being of molded plastic construction and having a base adapted to engage against the surface of the door panel and having at least one anchor leg projecting from the base, said panel having an aperture therein registering with each of the at least one anchor leg to permit the anchor leg to pass through the panel, and the each of the at least one anchor legs having a foot adapted to engage and underlie the underside of the panel when the housing is slid longitudinally along the surface so that the foot prevents the housing from being pulled away from the panel, and said housing having at least one locking legs projecting from the base, said panel having an opening therein registering with each of the at least one locking legs to permit the locking legs to pass through the panel, and said panel having a locking tab struck downwardly from the panel adjacent at least one of the panel openings, and at least one of the locking legs having a locking foot carried thereon and adapted to lockingly engage with the locking tab when the housing is slid longitudinally along the surface to prevent retrograde longitudinal sliding of the housing along the surface and thereby prevent the removal of the housing from the panel.

2. The combination of claim 1 further characterized by each of the locking feet having an abutment shoulder thereof adapted to engage with an associated locking tab struck downwardly from the panel to lock the longitudinal position of the housing relative to the panel.

3. The combination of claim 3 in which the locking foot carries an integrally molded spring finger which bears against a tab struck from the underside of the panel to urge retrograde longitudinal sliding movement of the housing to thereby maintain the abutment shoulder of the locking foot in engagement with the locking tab struck from the panel.

* * * * *